US008888202B2

(12) United States Patent
Johansson

(10) Patent No.: US 8,888,202 B2
(45) Date of Patent: Nov. 18, 2014

(54) PULL-OUT MECHANISM FOR A DRAWER

(75) Inventor: Tobias Johansson, Älmhult (SE)

(73) Assignee: Inter IKEA Systems B.V., Delft (NL)

( * ) Notice: Subject to any disclaimer, the term of this patent is extended or adjusted under 35 U.S.C. 154(b) by 580 days.

(21) Appl. No.: 12/450,222

(22) PCT Filed: Feb. 11, 2008

(86) PCT No.: PCT/IB2008/000295

§ 371 (c)(1),
(2), (4) Date: Sep. 16, 2009

(87) PCT Pub. No.: WO2008/099253

PCT Pub. Date: Aug. 21, 2008

(65) Prior Publication Data

US 2010/0026154 A1 Feb. 4, 2010

(30) Foreign Application Priority Data

Feb. 12, 2007 (DK) ..... 2007 00224

(51) Int. Cl.
*A47B 88/00* (2006.01)
*A47B 88/10* (2006.01)

(52) U.S. Cl.
CPC ..... *A47B 88/10* (2013.01); *A47B 2210/0059* (2013.01); *A47B 2210/0032* (2013.01); *A47B 2210/0037* (2013.01); *A47B 2210/0056* (2013.01); *A47B 2210/001* (2013.01); *A47B 2210/0043* (2013.01)
USPC ..... 312/334.9; 312/334.6

(58) Field of Classification Search
USPC ..... 312/334.1, 334.6, 334.9, 334.11, 312/334.12, 334.15–334.18, 334.35, 312/334.36–334.39
See application file for complete search history.

(56) References Cited

U.S. PATENT DOCUMENTS

| | | | | |
|---|---|---|---|---|
| 2,671,699 | A * | 3/1954 | Vignos | 384/18 |
| 3,164,419 | A * | 1/1965 | Michaelson | 384/18 |
| 4,752,142 | A * | 6/1988 | Jackson et al. | 384/18 |
| 4,752,143 | A * | 6/1988 | Lautenschlager, Jr. | 384/19 |
| 4,799,802 | A * | 1/1989 | Lautenschlager | 384/19 |
| 5,172,969 | A * | 12/1992 | Reuter et al. | 312/328 |
| 5,664,855 | A * | 9/1997 | Lautenschlager et al. | 312/334.4 |
| 5,709,443 | A * | 1/1998 | Lautenschlager | 312/334.14 |
| 5,769,518 | A | 6/1998 | Grabher | |
| 6,854,817 | B1 * | 2/2005 | Simon | 312/334.6 |

(Continued)

FOREIGN PATENT DOCUMENTS

| | | |
|---|---|---|
| DE | 19511999 | 10/1996 |
| EP | 0720824 | 7/1996 |
| EP | 0834270 | 4/1998 |
| FR | 1127644 | 12/1956 |

*Primary Examiner* — Darnell Jayne
*Assistant Examiner* — Andres F Gallego
(74) *Attorney, Agent, or Firm* — Cooper & Dunham LLP

(57) ABSTRACT

A pull-out mechanism for mounting a drawer in a drawer cavity of a piece of furniture. The mechanism may include an upper pull-out rail with a substantially U-shaped cross-section affixed to the drawer and may optionally include a lower rail with a substantially U-shaped cross-section affixed to a wall in a drawer cavity. The mechanism may also have an intermediate rail, which is disposed between the upper rail and the lower rail, or alternatively may support the upper rail while attaching to the wall. One or more bearing holders provided with at least one ball bearing and a plurality of rollers or wheels supports the upper rail and optional lower rail in a mounted relationship with the intermediate rail.

15 Claims, 4 Drawing Sheets

(56) References Cited

U.S. PATENT DOCUMENTS 6,945,620 B2 * 9/2005 Lam et al. ..... 312/334.6
2003/0173880 A1 * 9/2003 Thomas et al. ..... 312/334.38
2007/0046158 A1 * 3/2007 Hoffman ..... 312/333
2007/0080616 A1 * 4/2007 Lam et al. ..... 312/334.6

* cited by examiner

PULL-OUT MECHANISM FOR A DRAWER

TECHNICAL FIELD

The invention relates to a pull-out mechanism for mounting of a preferably large and heavy pull-out drawer in a drawer cavity in a piece of furniture, especially a filing cabinet, and which includes an upper rail with a substantially U-shaped cross-section, said upper pull-out rail being affixed to the drawer in the longitudinal direction of the drawer, and possibly a lower rail with a substantially U-shaped cross-section, said lower rail, possibly indirectly, being affixed to a wall in the drawer cavity, and an intermediate rail which in its longitudinal direction is movable between the upper rail and the lower rail, and where at least one bearing holder with rollers and balls is inserted between the intermediate rail and the upper rail and the lower rail respectively.

BACKGROUND

A mechanism is known for a drawer, where an intermediate rail is placed between an upper rail connected to a telescopic drawer and a lower rail, which is connected to the closet which the drawer is part of; said intermediate rail follows the drawer gradually when the drawer is pulled out of the closet. Pairs of rollers and bearing balls are placed between the rails; the bearing balls, however, make the pull-out mechanism rather complicated and thus vulnerable.

DISCLOSURE OF THE INVENTION

The aspect of the invention is to provide a pull-out mechanism of the above kind, and which facilitates a simpler, and thus more reliable, structure than known.

The pull-out mechanism according to the invention is characterised in that exactly one bearing ball is mounted in the part of the individual bearing holder placed on one side of the intermediate rail, whereas two rollers or wheels, the axes of which are placed in their individual planes of two planes standing perpendicular to each other, are mounted in the part of the above bearing holder, which is placed on the other side of the intermediate rail, where a substantially horizontal auxiliary roller extending to both sides of the intermediate rail is mounted in the bearing holder between the intermediate rail and the upper rail and the lower rail respectively. Hereby a considerably constructive simplification is achieved and the pull-out mechanism can bear both horizontal and vertical loads in a reliable way. Furthermore it is possible to pull out the drawer to a position just outside the actual piece of furniture.

Moreover, according to the invention, the invention may be modified such that the lower rail complete with bearing holder and roller and ball is removed, and that the lowermost part of the intermediate rail is affixed to the wall of the drawer cavity, possibly after bending of said lowermost part. Thereby it is achieved that the pull-out mechanism becomes simpler as it only has two rails now: the intermediate rail and the upper rail.

In a particular embodiment according to the invention, a more elevated auxiliary rail with a substantially U-shaped cross-section may be placed between the upper rail and the drawer, where the outer ends of the U are bent approx. 90° inwards, and where at least one auxiliary roller in at least one auxiliary holder is placed between the upper rail and the more elevated auxiliary rail. Thereby it is achieved that the pull-out mechanism works particularly reliably even when the drawer is pulled entirely out of the piece of furniture.

According to the invention, inclininglyextending web parts, which can serve for the fixation of the bearing holders in relation to the intermediate rail, may be provided locally on the intermediate rail. Hereby particularly good options are achieved for a reliable affixation of the bearing holders to the intermediate rail and thus a particularly reliable running of the drawer when it is pulled out or pushed in (closed).

According to a further embodiment of the invention, the intermediate rail may have a cross-section corresponding to an I, where the intermediate rail may preferably be manufactured by bending of a metal sheet, especially such that each of the webs of the intermediate rail includes two layers of metal sheets. Thereby it is achieved that the pull-out mechanism can be manufactured in a particularly simple way.

In a particular embodiment according to the invention, the individual bearing ball may be mounted in a cavity or a slot in the bearing holder, a part of the wall of the cavity or the slot preferably having the same curvature as the surface of the bearing ball. Thereby a particularly reliable retaining of the individual bearing ball in its bearing holder is achieved.

According to the invention, the individual bearing ball may have a diameter of more than 2 mm, preferably more than 3.5 mm. Thereby it is achieved that the pull-out mechanism can bear considerable weight from the drawer.

According to a particular embodiment according to the invention, one or more cramping means for affixing the piece of furniture to the floor or wall in the room, in which the piece of furniture is to be placed, are joined in connection to the pull-out mechanism—possibly, however, to the outer side of the piece of furniture. Hereby it is ensured that the piece of furniture does not tilt towards (or onto) a user who has pulled or is pulling one or more drawers out of the piece of furniture.

Finally, according to the invention, at least one auxiliary wheel, which is placed between the elevated auxiliary rail and the upper rail, is mounted to the upper rail. Hereby it is achieved that the load from the weights in the drawer is transferred particularly reliably to the piece of furniture.

BRIEF DESCRIPTION OF THE DRAWINGS

The invention is explained in detail below with reference to the drawings, in which.

DETAILED DESCRIPTION OF THE INVENTION

Figure 1:
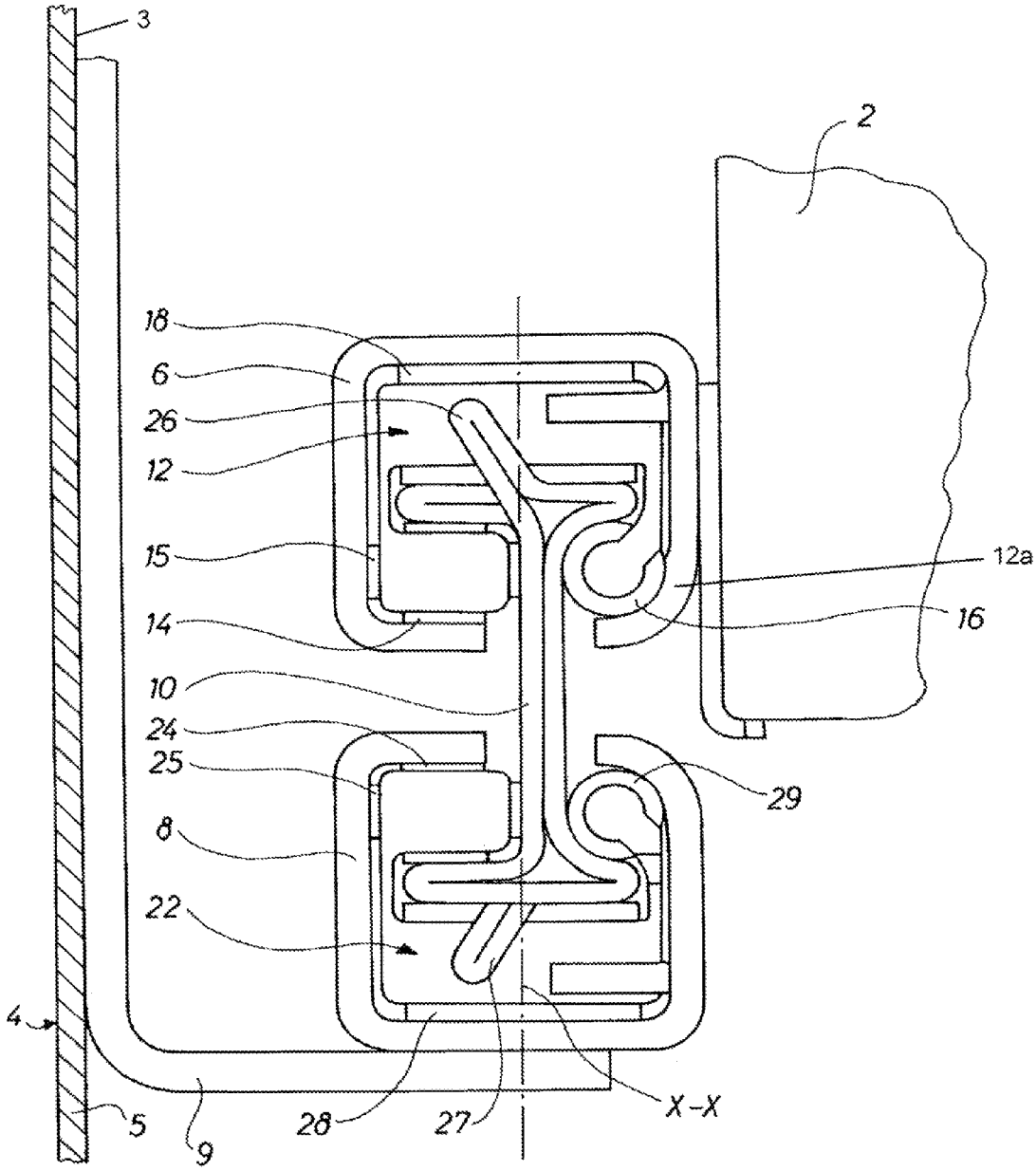
FIG. 1 shows a cross-section in a first embodiment of a pull-out mechanism according to the invention including an upper rail, a lower rail as well as an intermediate rail placed between the upper fail and the lower rail.
Figure 4:
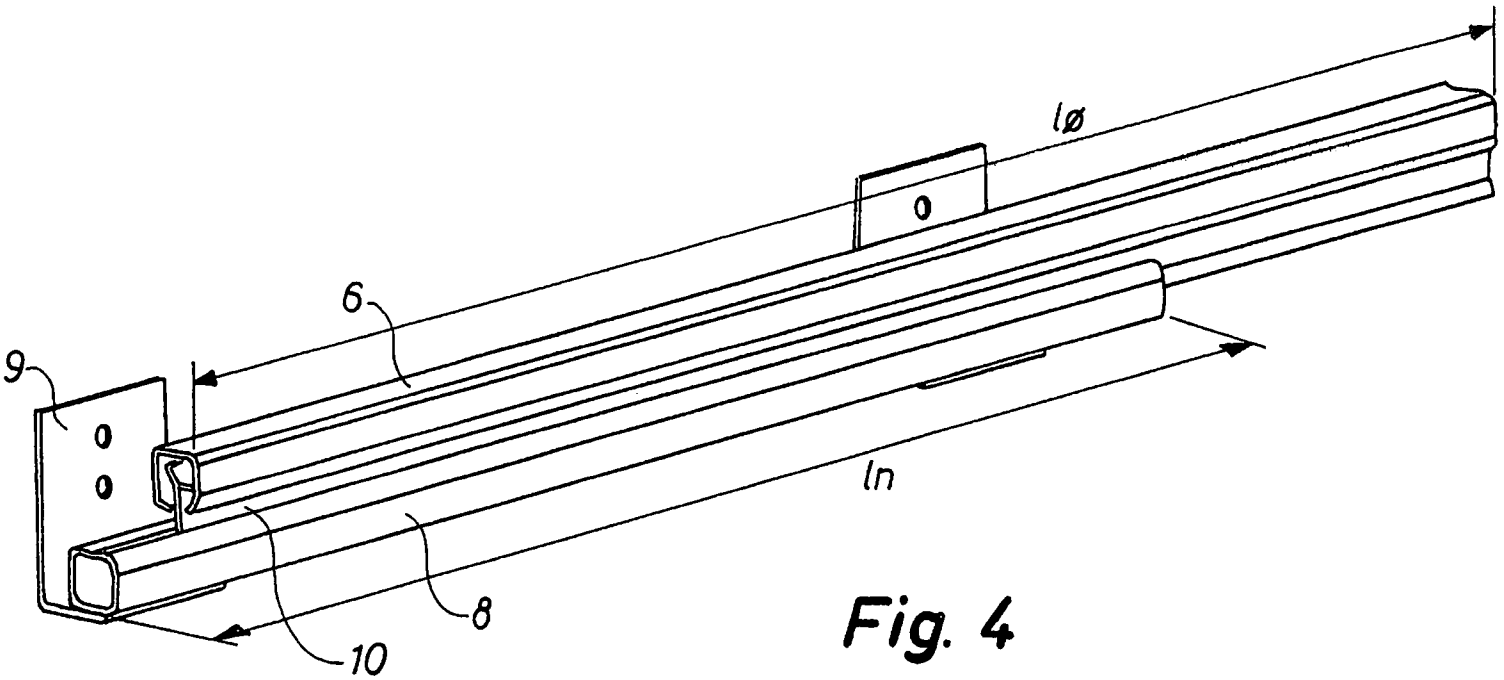
FIG. 4 is a perspective view of a pull-out mechanism according FIG. 1.

The pull-out mechanism 1 shown in FIGS. 1 and 4 is intended for mounting of a preferably big and heavy drawer 2 in a drawer cavity 3 inside a piece of furniture 4. The latter may e.g. be a filing cabinet. The pull-out mechanism 1 includes an upper pull-out rail 6, which is fastened to the drawer 2 in the longitudinal direction of the drawer (i.e. perpendicular to the plane of the paper in FIG. 1), and a lower rail 8, which is fastened to a wall 5 in the drawer cavity 3 of the piece of furniture 4 by means of fittings 9. An intermediate rail 10 is placed between the upper rail 6 and the lower rail 8, said intermediate rail being movable in its longitudinal direction, cf. FIG. 4, while it is placed between rails 6 and 8. Between the intermediate rail 10 and the upper rail 6—and at the same time to the left of the intermediate rail, especially its vertical centre plan X-X—a bearing holder 12 is inserted; possibly one or more additional bearing holders may be provided which are placed further back behind the plane of the paper. Each bearing holder is provided with two rollers 14 and 15, the one roller 14 having a horizontal axis of rotation not shown and the other roller 15 having a vertical axis of rotation not shown. A bearing ball 16 is mounted to a part 12*a* of the individual bearing holder 12, said part being placed at the right side of the intermediate rail 10. As can be seen, the roller 14 can bear vertical loads in the pull-out mechanism while the roller 15 can bear horizontal loads; the ball 16 can bear both vertical and horizontal loads. As shown, a wide, substantially horizontal auxiliary roller 18 is mounted between the upper rail 6 and the intermediate rail 10; said auxiliary roller 18 extends into both sides of the intermediate roller 10, i.e. both sides of the vertical centre plane X-X of the intermediate roller 10.

As shown in FIG. 1, at least two bearing holders 22 may be inserted between the intermediate rail 10 and the lower rail 8, where two rollers 24 and 25 (corresponding to the afore-mentioned roller 14 and afore-mentioned roller 15) are mounted between the intermediate rail 10 and the lower rail 8. These rollers are at the same side of the aforementioned centre plane X-X as the rollers 14 and 15. Precisely one bearing ball is placed at the opposite side of the centre plane X-X—i.e. at the same side as the ball 16. An auxiliary roller 28 is mounted between the intermediate rail 10 and the lower rail 8, said auxiliary roller extending on both sides of the vertical centre plane X-X of the intermediate rail 10, i.e. in substantially the same way as the auxiliary roller 18.

When the pull-out mechanism shown in FIGS. 1 and 4 is used in connection with pulling out or pushing in a drawer, the pull-out mechanism can bear both vertical loads in a reliable way (e.g. the weight of items placed in the drawer) and horizontal loads (e.g. loads arising from the drawer not being pulled out of the drawer cavity evenly, but "wobbling" slightly). The loads to be absorbed sideways, however, are considerably smaller than the loads to be transferred vertically by the pull-out mechanism.

Figure 2:
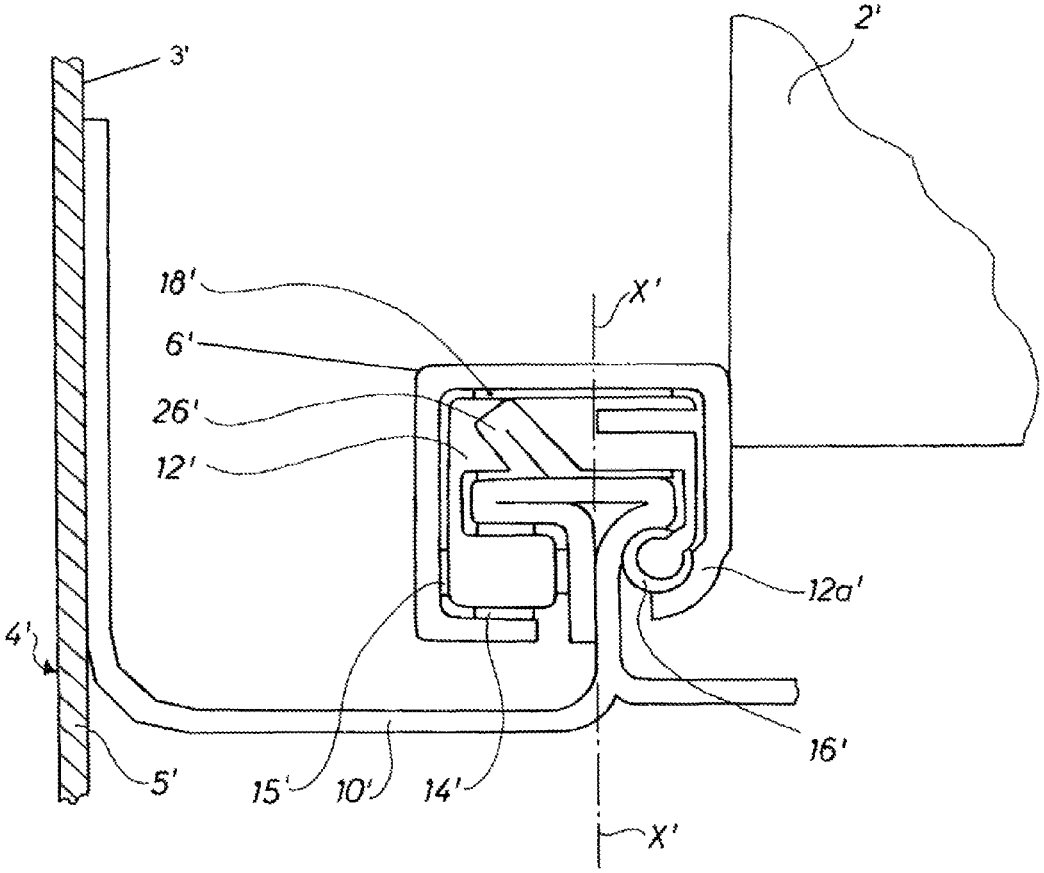
FIG. 2 shows another embodiment of the pull-out mechanism according to the invention including an upper rail and an intermediate rail, and where a part of the latter is bent sideward for affixing to a wall in the drawer cavity of the piece of furniture.

FIG. 2 shows another embodiment of the pull-out mechanism according to the invention. It includes an upper pull-out rail 6' and an intermediate rail 10', but the lower rail (compare rail 8 in FIG. 1) does not exist. The intermediate rail 10' is bent sideward and fastened to a wall 5' of a piece of furniture 4' defining the drawer cavity 3'. The drawer 2', which is to be able to be pulled out and pushed in, is affixed to the side of the upper rail 6' as shown, but it may also be affixed on top of the latter.

As shown, precisely one bearing ball 16' is mounted to a part 12*a'* between the upper rail 6' and the intermediate rail 10' —at the one side of a vertical "centre plane" X'-X' (partly corresponding to the plane X-X in FIG. 1) —and two rollers or wheels 14', 15' (the axes of which lie in two planes being perpendicularly on each other, said planes being perpendicular on the plane of the paper) are mounted at the other side of the afore-mentioned vertical centre plane. A transverse auxiliary roller 18', which extends at both sides of the afore-mentioned vertical centre plane X'-X', is placed above the rollers/wheels 14', 15'.

Figure 3:
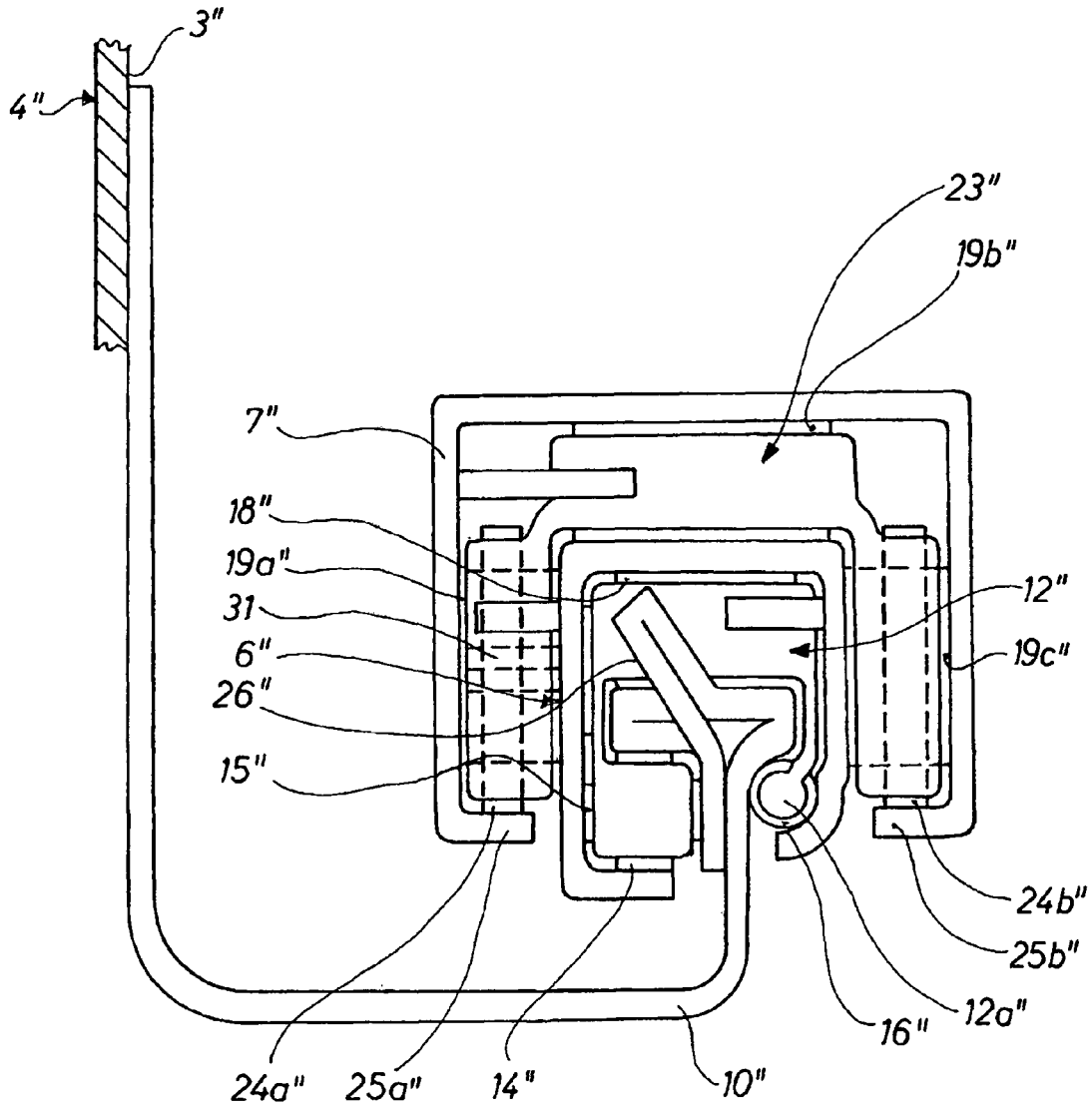
FIG. 3 shows a third embodiment of the pull-out mechanism according to the invention, where an elevated auxiliary rail is placed between the upper rail and a drawer, said elevated auxiliary rail being affixed to the drawer whereas a part of the intermediate rail is bent sideward for affixing to a wall in the drawer cavity.

As shown in FIG. 3, a substantially U-shaped auxiliary rail 7" may be mounted on the outside of and above the upper rail 6". In this case the drawer (not shown) is mounted on the auxiliary rail 7". Inside the upper rail 6", a rail 10" is bent sideward and fastened to a wall 4" defining a drawer cavity 3", is mounted by means of just one bearing ball 16"; the bearing ball 16" is mounted at part 12*a"* and placed at one side of the rail 10", while on the other side of said rail 10" two rollers or wheels 14", 15", corresponding to the rollers or wheels 14', 15' in FIG. 2, are placed. Furthermore, a transverse roller 18" corresponding to roller 18' in FIG. 2 is provided. As shown, at least one auxiliary roller, here more specifically three auxiliary rollers 19*a"*, 19*b"* and 19*c"*, may be inserted between the elevated auxiliary rail 7" and the outer side of the upper rail 6". This roller or these rollers are mounted onto —or rather into the recess in —an elevated bearing holder 23". The auxiliary rollers 9*a"* and 19*c"* can rotate around their individual axes (not shown) when the auxiliary rail 7" is pulled out. Similarly the auxiliary wheels 24*a"* and 24*b"* can rotate around their individual horizontal axes, cf. e.g. axis 31, which is indicated with dots and which is affixed onto the rail 6".

While the outer ends of rail 6" are bent mainly 90° inwards, the same may also apply to the auxiliary rail 7", cf. the inwardly bent parts 25*a"* and 25*b"*.

As shown in FIGS. 1, 2 and 3, incliningly extending web parts 26, 27, 26', 26", which can serve for the affixation of the mentioned bearing holders 12, 22, and 12', 12" respectively, may be provided on the intermediate rail 10, 10' and 10" in relation to the intermediate rail 10 and 10', 10".

As shown in FIG. 1, the intermediate rail 10 may have a cross-section substantially corresponding to an I, and said rail may preferably be manufactured by bending of a metal sheet, each of the webs of the intermediate rail including two layers of metal sheet.

The individual bearing ball 16, 29, 16', 16" may be mounted in a cavity or a slot in the bearing holder 12, 22, 12', 12", which, however, is not shown; in this case a part of the wall of the cavity or the slot has substantially the same bending as the surface of the bearing ball, thus efficiently keeping the latter in its place.

The individual bearing ball 16, 29, 16', 16" may have a diameter of more than 2 mm, preferably more than 3.5 mm.

FIG. 4 is a perspective view—cf. FIG. 1—of how the lower rail 8, the intermediate rail 10 and the upper rail 6 may extend in relation to each other. Preferably the rails are equally long, the lengths may, however, also be differing as shown in FIG. 1, as the upper rail 6 and the intermediate rail 10 may be relatively long (have the length $l_ø$), while the lower rail 8 may be somewhat shorter (have the length $l_n$); thus $l_ø$ is considerably bigger than $l_n$.

The invention may be varied in many ways without deviating from the idea behind the invention. Thus rails, bearing holders, balls and rollers may be manufactured from various different materials. Preferably the rails are steel rails, while the bearing holders may be of hard plastics, and rollers and balls may be of the kind used in ball bearings and roller bearings. Regarding FIGS. 2 and 3, the rail 10' and 10" respectively may be affixed indirectly onto the wall 3' and 3" respectively.

The invention claimed is:

1. A pull-out mechanism for mounting a drawer in a drawer cavity comprising:

an upper rail having a substantially U-shaped cross-section, said upper rail being aligned with the drawer, and an intermediate rail which is positioned below the upper rail, wherein a bearing holder is disposed between a first end of the intermediate rail and the upper rail, wherein in a cross section perpendicular to the longitudinal axis of the upper rail a single bearing ball is mounted on the bearing holder providing a first horizontal and vertical load support of the pull out mechanism on a first side of a vertical center plane of the intermediate rail, and wherein two rollers or wheels are mounted on the bearing holder such that the axes of rotation of the two rollers or wheels are perpendicular to each other providing a cooperating second horizontal and vertical load support of the pull out mechanism on a second opposing side of the vertical center plane of the intermediate rail, and wherein a substantially horizontal auxiliary roller is mounted on the bearing holder such that it bears against the first end of the intermediate rail and is disposed between the intermediate rail and the upper rail providing horizontal load support of the pull out mechanism.

2. The pull out mechanism according to claim 1, wherein the first end of the intermediate rail is provided with an incliningly extending web part, wherein said web part is configured to secure the bearing holder in sliding relation to the intermediate rail.

3. The pull-out mechanism according to claim 2, wherein the intermediate rail has a cross-section substantially corresponding to an I, and wherein the intermediate rail is provided by bending a metal sheet such that the web part of the intermediate rail comprises two layers of folded metal sheeting.

4. The pull-out mechanism according to claim 1, further comprising a lower rail affixed to a wall of the drawer cavity, wherein a further bearing holder is disposed between a second end of the intermediate rail and the lower rail, and a bearing ball is mounted on the further bearing holder such that it bears against a first side of the second end of the intermediate rail, and further characterized in that two rollers or wheels are mounted on the further bearing holder such that the axes of rotation of the two rollers or wheels are perpendicular to each other, and the two rollers or wheels bear against a second side of the second end of the intermediate rail, and a substantially horizontal auxiliary roller is mounted on the further bearing holder such that it bears against a third side of the second end of the intermediate rail and is disposed between the intermediate rail and the lower rail.

5. The pull-out mechanism according to claim 1, wherein the single bearing ball is mounted on the bearing holder in a space between the upper rail and the intermediate rail, wherein the curvature of the space matches the curvature of an outer surface of the bearing ball.

6. The pull-out mechanism according to claim 1, wherein the single bearing ball has a diameter of more than 2 mm.

7. A pull-out mechanism for mounting a drawer in a drawer cavity in a piece of furniture, the pull-out mechanism comprising:

an upper rail having a substantially U-shaped cross-section, said upper rail being affixed to the drawer; and a lower rail having a substantially U-shaped cross-section, said lower rail being affixed to a wall in the drawer cavity;

an intermediate rail which is longitudinally movable between the upper rail and the lower rail;

an upper bearing holder having rollers and in a cross section perpendicular to the longitudinal axis of the upper rail a single bearing ball positioned between the intermediate rail and the upper rail, and a lower bearing holder having rollers and in a cross section perpendicular to the longitudinal axis of the upper rail a single bearing ball positioned between the intermediate rail and the lower rail, wherein, for each bearing holder, the single bearing ball is mounted providing a first horizontal and vertical load support of the pull out mechanism on a first side of a vertical center plane of the intermediate rail, and wherein, for each bearing holder, two rollers or wheels whose axes of rotation are perpendicular to each other are mounted providing a cooperating second horizontal and vertical load support of the pull out mechanism on an opposing second side of the vertical center plane of the intermediate rail, and wherein a substantially horizontal auxiliary roller is positioned on both sides of the intermediate rail and is mounted on at least one of the upper or lower bearing holders providing horizontal load support of the pull out mechanism.

8. The pull-out mechanism according to claim 7 , wherein the drawer comprises a large and heavy drawer.

9. The pull-out mechanism according to claim 8, wherein the piece of furniture comprises a filing cabinet.

10. The pull-out mechanism according to claim 7, further comprising at least one incliningly extending web part provided integrally with the intermediate rail, wherein the at least one web part is configured to fix the bearing holders in sliding relation to the intermediate rail by extending at an angle from surfaces of the intermediate rail.

11. The pull-out mechanism according to claim 10, wherein the intermediate rail has a cross-section substantially corresponding to an I, and wherein the intermediate rail is provided by folding a metal sheet such that the at least one web part of the intermediate rail includes two layers of metal sheeting.

12. The pull-out mechanism according to claim 7, wherein the lower rail is affixed to the wall in the drawer cavity by a metal fitting.

13. The pull-out mechanism according to claim 7 wherein each single bearing ball is mounted in a cavity or a slot, and wherein a part of a wall of the cavity or the slot has a same curvature as a surface of each single bearing ball.

14. The pull-out mechanism according to claim 7 wherein each single bearing ball has a diameter of more than 3.5 mm.

15. A pull-out mechanism for mounting a drawer in a drawer cavity in a piece of furniture, the pull-out mechanism comprising:

an upper pull-out rail having a substantially U-shaped cross-section, said upper pull-out rail being affixed to the drawer in the longitudinal direction of the drawer; and an intermediate rail, wherein the upper pull-out rail is longitudinally movable with respect to the intermediate rail; at least one bearing holder having rollers and in a cross section perpendicular to the longitudinal axis of the upper rail a single bearing ball positioned between the intermediate rail and the upper rail, wherein the single bearing ball is mounted on the bearing holder providing a first horizontal and vertical load support of the pull out mechanism on a first side of a vertical center plane of the intermediate rail and wherein two rollers or wheels whose axes of rotation are perpendicular to each other, are mounted on the bearing holder providing a cooperating second horizontal and vertical load support of the pull out mechanism on an opposing second side of the vertical center plane of the intermediate rail, and a substantially horizontal-auxiliary roller is mounted on the bearing holder between the intermediate rail and the upper rail, providing vertical load support for the pull out mechanism.

* * * * *